United States Patent [19]

Rand

[11] 4,012,847

[45] Mar. 22, 1977

[54] SOLVENT RECOVERY SYSTEM

[75] Inventor: Burton Rand, Norristown, Pa.

[73] Assignee: Autosonics Inc., Norristown, Pa.

[22] Filed: Nov. 24, 1975

[21] Appl. No.: 634,400

[52] U.S. Cl. ..... 34/75; 34/77; 34/78; 34/155; 68/18 F

[51] Int. Cl.[2] ..... F26B 21/06

[58] Field of Search ..... 34/73–78, 34/155; 68/18 R, 18 F, 18 C

[56] References Cited

UNITED STATES PATENTS

| | | | |
|---|---|---|---|
| 2,660,869 | 12/1953 | McDonald | 68/18 R |
| 2,828,862 | 4/1958 | Johnson | 68/18 F |
| 3,116,625 | 1/1964 | Stewart | 68/18 C |
| 3,236,073 | 2/1966 | Davison et al. | 34/77 |
| 3,426,446 | 2/1969 | Lotzsch | 68/18 C |
| 3,854,224 | 12/1974 | Yamaji et al. | 34/155 |
| 3,890,721 | 6/1975 | Katayama et al. | 34/155 |

*Primary Examiner*—John J. Camby
*Assistant Examiner*—Henry C. Yuen
*Attorney, Agent, or Firm*—Seidel, Gonda & Goldhammer

[57] ABSTRACT

Solvent is vaporized from a work product as the product moves through a process which may be a heated chamber. The vaporized solvent is withdrawn from the chamber and passed through a chiller to recover a portion of the vapor. The output from the chiller is then passed through an adsorber to remove the remainder of the solvent.

12 Claims, 1 Drawing Figure

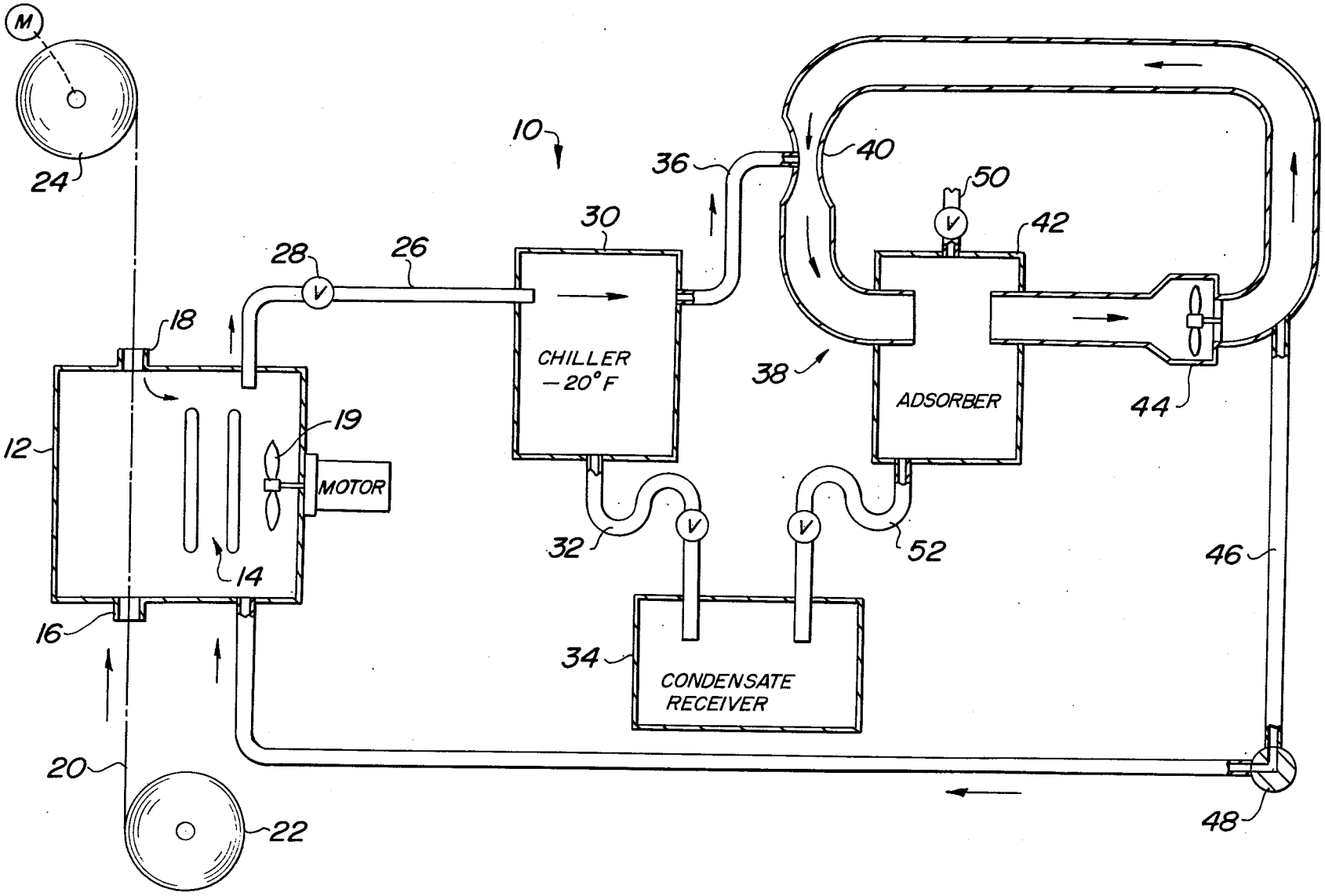
ADSORBER
CONDENSATE RECEIVER
CHILLER -20°F
MOTOR
10
12
14
16
18
19
20
22
24
26
28
30
32
34
36
38
40
42
44
46
48
50
52
M

SOLVENT RECOVERY SYSTEM

BACKGROUND

The present invention is directed to a solvent recovery system of the type disclosed in U.S. Pat. Nos. 1,811,107 and 3,256,613. Relevant prior art includes U.S. Pat. Nos. 3,049,904 and 3,078,701.

Specific problems and/or disadvantages with prior art systems having an adsorber such as a carbon bed, were:

1. the need for relatively high air exhaust to outdoors,
2. the decomposition of adsorber was accelerated by introducing other pollutants from the surrounding plant atmosphere which are introduced to the adsorber along with the solvent vapor to be recovered.
3. the large size of adsorber required initial high cost, high installation cost, high maintenance and operating cost.

DISCLOSURE

The present invention is directed to a solvent recovery system may include a process chamber having an inlet and outlet as well as means for accelerating the vaporizing of solvent from a work product as the work product moves through the chamber. A means is provided to recover the vaporized solvent in two stages. A chiller is provided and constitutes the first stage for recovery of some of the vaporized solvent. The chiller has an inlet which communicates with the drying chamber.

An air circulation system communicates with the outlet of the chiller and includes an adsorber. The absorber is the second stage for recovery of the vaporized solvent. A means is provided to cause the air and vaporized solvent to flow from the process chamber to the chiller at a low flow rate which is less than 50% of the flow rate of the air circulation system.

In a specific embodiment of the present invention, the chiller operates at a low temperature which is below ambiant and preferably below the freezing point of water such with the optimum temperature being about −20°F. Air and vaporized solvent is caused to flow from the heating chamber to the chiller at a low flow rate such as about 5–100 or more cubic feet per minute depending on size of system. The low flow rate of is to be compared with the high flow rate through the air circulation system and the adsorber which may be as low as 100 cubic feet per minute and as high as 800 or more cubic feet per minute. The provision of the chiller upstream from the adsorber permits the adsorber to be smaller, lighter in weight, less expensive and easier to install not necessarily whereby the entire solvent recovery system may be smaller, lighter, and less expensive.

It is an object of the present invention to provide a solvent recovery system which utilizes a chiller upstream from an adsorber together with means for causing air flow at a low flow rate from a process chamber to the chiller and then to the adsorber for sequential recovery of vaporized solvent.

Others objects will appear hereinafter.

For the purpose of illustrating the invention, there is shown in the drawings a form which is presently preferred; it being understood, however, that this invention is not limited to the precise arrangements and instrumentalities shown.

In the drawing, there is illustrated a diagrammatic representation of the solvent recovery system of the present invention.

Referring to the drawing in detail, wherein like numerals indicate like elements, there is shown a solvent recovery system in accordance with the present invention designated generally as 10.

The system 10 includes a housing 12 which constitutes a process chamber. Within or associated with the process chamber of housing 12, there may be provided a heating means 14 of any conventional type. The housing 12 is provided with an inlet 16 in a bottom wall and an outlet 18 in a top wall.

A work product such as a web 20 is unwound from roll 22, passed through the process chamber, and then wound on motor driven roll 24. Web 20 contains a solvent diluent thereon as a result of having printing or other matter applied to the web. Alternatively, the work product may be a work piece which is to be degreased by passage through the process chamber. As the web 20 passes through the process chamber, the solvent is flashed to vapor using heat or desaturated air.

It will be noted that the inlet 16 and outlet 18 are unsealed. The inlet 16 and outlet 18 may be provided with conventional seals if desired. Seals at the inlet and outlet are not deemed necessary as will be described hereinafter. Blower 19 creates air turbulence within the process chamber to accelerate the release of entrained solvent from the work product.

A conduit 26 is provided with a selectively operable valve 28 for controlling the rate of flow therethrough. One end of conduit 26 communicates with the process chamber within housing 12. The other end of conduit 26 is connected to a chiller 30.

The chiller 30 is only diagrammatically shown. Thus, there is no illustration of the coils and conduits for circulating a refrigerant through the coils at a temperature as described above. As the vapor-laden air flows through the chiller 30, a large portion of the vaporized solvent is removed by condensation. The amount of vapor removed by chiller 30 may be 50% or more depending upon air temperature, solvent saturation of the air, chiller temperature and flow rate. The condensation is communicated directly to a condensate receiver 34 by way of a drain conduit and trap 32. The chiller 30 removes at least one-half of the vaporized commercial solvents, such as halogenated hydrocarbons, fluorocarbon solvents, alcohols, etc.

An air circulation system 38, preferably in the form of a closed loop, has a venturi 40. A conduit 36 has one end communicating with the outlet of the chiller 30. The other end of the conduit 36 is connected to the venturi 40. Hence, flow through the venturi 40 will create the suction for causing air and vapor to flow from the heating chamber and through the chiller 30.

The system 38 includes an adsorber 42 such as a carbon bed. Air and vapor flow through the system 38 as a result of the large capacity blower 44. The adsorber 42 is located between the venturi 40 and the blower 44.

Downstream from the blower 44 there is provided an exit conduit 46. Conduit 46 extends to the process chamber within housing 12. A portion of the air from the system 38 may be returned to the housing 12 by way of conduit 46. Conduit 46 is preferably provided with a selectively operable two-way valve 48 which provides the optional alternative of communicating conduit 46 with the atmosphere instead of the process chamber. If air is returned to housing 12 via conduit 46 at about the same flow rate as was withdrawn from housing 12 via conduit 26, there is no substantial draft into housing 12 via inlet 16 and outlet 18.

Steam or some other stripping medium is introduced into the adsorber 42 by way of valve conduit 50. Any condensate stripped from the carbon or other medium in adsorber 42 is communicated to the condensate receiver 34 by way of a valved conduit and trap 52. If desired or required due to locations involved, adsorber 42 may be provided with a condensate receiver separate from receiver 34 or may discharge into a drain or tank.

The chiller 30 operates with best efficiency when the flow rate through conduit 26 is adjusted so as to be less than 50% of the flow rate in system 38. The efficiency of operation of adsorber 42 is best when the flow rate in system 38 is high such as between 100 and 800 or more cfm. A preferred operating range for the flow rate in conduit 26 is between 5 and 20 cfm. Due to the substantial removal of chlorinated hydrocarbons or commercial solvents from the vaporized solvent by the chiller 30, the adsorber 42 may be smaller and less expensive in cost and installation.

When operating chiller 30 with a refrigerant at −20°F., a defrost means is needed which may be automatically timed and actuated.

The present invention may be embodied in other specific forms without departing from the spirit or essential attributes thereof and, accordingly, reference should be made to the appended claims, rather than to the foregoing specification as indicating the scope of the invention.

I claim:

1. A solvent recovery system comprising a housing defining a process chamber, said chamber having an inlet and an outlet and confining solvent vaporized from a work product as the product moves through the chamber, means for recovering vaporized solvent from said chamber in two stages, a chiller for removing a portion of said vaporized solvent and constituting the first stage, said chiller having an inlet communicating with said chamber, an air circulation system communication with an outlet of said chiller, said air circulation system including an adsorber which is the second stage for recovery of vaporized solvent, and means for causing air and vaporized solvent to flow from said housing to said chiller and then to said air circulation system with the rate of flow from said housing to said chiller being at least 5 cfm but substantially less than the flow rate of said air circulation system.

2. A system in accordance with claim 1 wherein said chiller has an operating temperature less than the freezing temperature of water.

3. A system in accordance with claim 1 wherein the last- mentioned means limits the flow through the chiller to a flow rate which is less than 50% of the flow rate in said air circulation system.

4. A system in accordance with claim 3 wherein the flow rate between said chamber and chiller is between 5 and 20 cfm.

5. A system in accordance with claim 1 wherein said air circulation system is substantially a closed loop and includes a venturi and blower, a conduit extending from the outlet of said chiller to said venturi so that air flow through the venturi constitutes the means for causing flow of air and vaporized solvent from said process chamber to said chiller and then to said air circulation system.

6. A system in accordance with claim 1 including conveying means for the work in the form of a continuous moving product.

7. A solvent recovery system comprising a housing defining a process chamber and having an inlet and an outlet, means associated with said chamber for directing dry air to a work product as the work product moves through the chamber for vaporizing solvent from the work product, means for recovering vaporized solvent from said chamber, said solvent recovery means including a chiller and an adsorber in series, said adsorber being part of a circulation system having a blower downstream from the adsorber and with the upstream portion of said adsorber communicating with the outlet of the chiller, said chiller inlet communicating with said chamber, and means for causing air and vaporized solvent to flow from said heating chamber to said chiller and then to said air circulation system with the flow rate from said housing to said chiller being substantially less than the flow rate in said circulation system whereby vaporized solvent is recovered initially by condensaion at a low flow rate and then adsorption at a substantially higher flow rate.

8. A system in accordance with claim 7 wherein said chiller is arranged to operate at a temperaure substantially lower than freezing point of water at sea level.

9. A system in accordance with claim 7 including a valved conduit extending between said circulation system and said housing for selective return of air to said housing

10. A system in accordance with claim 7 wherein said housing inlet and outlet are aligned with one another.

11. A system in accordance with claim 7 including a condensate receiver, a conduit extending between said chiller and said receiver, another conduit extending from said adsorber to said receiver, each of said last-mentioned conduits having a means to prevent air from flowing from the receiver to said chiller and adsorber.

12. A system in accordance with claim 7 wherein said chiller is arranged to operate at a temperature below ambient temperature.

* * * * *